US008646121B2

(12) United States Patent
Nguyen

(10) Patent No.: US 8,646,121 B2
(45) Date of Patent: Feb. 11, 2014

(54) STEAM AND SAUNA SHOWER PANEL

(71) Applicant: Huan Thanh Nguyen, Huntington Beach, CA (US)

(72) Inventor: Huan Thanh Nguyen, Huntington Beach, CA (US)

( * ) Notice: Subject to any disclaimer, the term of this patent is extended or adjusted under 35 U.S.C. 154(b) by 0 days.

(21) Appl. No.: 13/694,262

(22) Filed: Nov. 14, 2012

(65) Prior Publication Data

US 2013/0305448 A1 Nov. 21, 2013

Related U.S. Application Data

(63) Continuation-in-part of application No. 11/820,319, filed on Jun. 19, 2007, now abandoned.

(51) Int. Cl.
*A47K 3/022* (2006.01)

(52) U.S. Cl.
USPC ..... 4/601; 4/533; 4/598

(58) Field of Classification Search
USPC ..... 4/596, 525, 524, 111.1, 533, 598, 601, 4/605, 610; 601/157, 169
See application file for complete search history.

(56) References Cited

U.S. PATENT DOCUMENTS

| | | | | | |
|---|---|---|---|---|---|
| 2,902,580 | A * | 9/1959 | Lowe et al. | 392/325 |
| 2,966,311 | A * | 12/1960 | Davis | 239/273 |
| 3,007,178 | A * | 11/1961 | Altman et al. | 4/525 |
| 3,293,666 | A * | 12/1966 | Casalini | 4/525 |
| 3,786,231 | A * | 1/1974 | Torvfelt | 392/370 |
| 3,936,891 | A * | 2/1976 | Kulde | 4/525 |
| 4,084,271 | A * | 4/1978 | Ginsberg | 4/524 |
| 4,224,700 | A * | 9/1980 | Bloys | 4/568 |
| 4,340,981 | A * | 7/1982 | Vanags | 4/536 |
| 4,424,598 | A * | 1/1984 | Cima | 4/524 |
| 4,575,882 | A * | 3/1986 | Diamond | 4/559 |
| 4,833,739 | A * | 5/1989 | Sakakibara et al. | 4/524 |
| 4,858,257 | A * | 8/1989 | Bivens | 4/606 |
| 4,862,526 | A * | 9/1989 | Berger | 4/536 |
| 5,070,549 | A * | 12/1991 | Campe | 4/596 |
| 5,142,713 | A * | 9/1992 | Makool | 4/525 |
| 5,255,399 | A * | 10/1993 | Park | 4/525 |
| 5,319,812 | A * | 6/1994 | Hanrahan et al. | 4/663 |
| 5,329,650 | A * | 7/1994 | Zaccai et al. | 4/605 |
| 5,335,378 | A * | 8/1994 | Chiang | 4/606 |
| 6,481,028 | B1 * | 11/2002 | Hsia | 4/570 |
| 6,503,212 | B2 * | 1/2003 | Park | 601/158 |
| 7,013,504 | B2 * | 3/2006 | Brunelle et al. | 4/597 |
| 7,168,108 | B2 * | 1/2007 | Guerin et al. | 4/596 |
| 7,889,187 | B2 * | 2/2011 | Freier et al. | 345/184 |
| 2004/0068789 | A1 * | 4/2004 | Pastorelli | 4/596 |
| 2004/0184793 | A1 * | 9/2004 | Schaeffer et al. | 392/416 |
| 2004/0231042 | A1 * | 11/2004 | Carter | 4/559 |
| 2005/0086736 | A1 * | 4/2005 | Helmetsie et al. | 4/596 |
| 2005/0086737 | A1 * | 4/2005 | Leung | 4/601 |
| 2005/0120474 | A1 * | 6/2005 | Wegdam et al. | 4/596 |
| 2005/0251906 | A1 * | 11/2005 | Scott et al. | 4/668 |
| 2006/0064815 | A1 * | 3/2006 | Guerin et al. | 4/596 |
| 2006/0207012 | A1 * | 9/2006 | DeBoer et al. | 4/601 |

(Continued)

*Primary Examiner* — Len Tran
*Assistant Examiner* — Viet Le

(57) ABSTRACT

An apparatus for converting a normal shower room into a steam and sauna facility. The apparatus comprises a vertical panel, a rain shower, a hand held massage means, a back and foot massage means, a seat with seat massage means, a steam and hot air generating means. The apparatus also includes an electronic device incorporating radio, CD player Hook Up, Telephone, Video features and buttons for controlling steam, heat, massage means, Audio and Video means.

1 Claim, 10 Drawing Sheets

(56) References Cited

U.S. PATENT DOCUMENTS

| | | | | |
|---|---|---|---|---|
| 2006/0207013 | A1* | 9/2006 | Deboer et al. | 4/601 |
| 2006/0207014 | A1* | 9/2006 | DeBoer et al. | 4/601 |
| 2006/0218718 | A1* | 10/2006 | Deboer et al. | 4/596 |
| 2006/0260037 | A1* | 11/2006 | Chen | 4/524 |
| 2007/0261161 | A1* | 11/2007 | Avigdor | 4/598 |
| 2008/0184478 | A1* | 8/2008 | Howard | 4/596 |
| 2008/0250556 | A1* | 10/2008 | Mang et al. | 4/601 |
| 2009/0000022 | A1* | 1/2009 | Phipps et al. | 4/601 |
| 2009/0031491 | A1* | 2/2009 | Altman et al. | 4/597 |
| 2009/0056009 | A1* | 3/2009 | Matsubara et al. | 4/524 |
| 2009/0222070 | A1* | 9/2009 | Daffer | 607/91 |
| 2010/0125944 | A1* | 5/2010 | Prodzenski | 4/601 |
| 2010/0199420 | A1* | 8/2010 | Lee | 4/601 |
| 2010/0204760 | A1* | 8/2010 | Lawliss | 607/83 |
| 2010/0242166 | A1* | 9/2010 | Chan | 4/601 |
| 2011/0277231 | A1* | 11/2011 | Zhadanov et al. | 4/601 |

* cited by examiner

1) Computer Control Box 2) →Electric Switch 3) →Sauna Generator 4) →Sanitizer

5) Video Screen 6) →Steam Nozzle 7) →Sauna Exhaust 8) →Steam generator

STEAM AND SAUNA SHOWER PANEL

BACKGROUND

The present invention relates in general to shower systems, and more particularly to an apparatus for converting a normal shower into a steam, sauna and massage facility.

Several shower systems have been developed in the art. For example, U.S. Pub. No. 20060248640 to Leong discloses an apparatus able to convert a conventional stall shower into a multi-purpose shower facility, including a steam bath, a hand-held shower, a water massage and a rain shower. It can be used with either single water input line or two separate hot and cold water input lines. The single water input line fit with the single output line of a common stall shower. To match different situations, two types of steam generator are also disclosed.

U.S. Pat. No. 3,936,891 to Kulde discloses a shower spray massage-sauna equipment suitable for installation into existing bathrooms by adding a water diverter valve between the shower head and the shower arm pipe and using a connecting hose to direct the water from the shower head to the shower spray massage-sauna spray arm. This spray arm is mounted on the wall opposite to the shower water control valves to allow the user to sit on a seat and to control the temperature and the force of the water. This spray arm also supports the flexible body enclosing cover and is adjustable to suit the height of the person using it. The cover has a round opening for the head at the top and partable opening at the front to permit the entry and the exit of the user. This equipment can be left in the bathroom in the non-use position or it can be easily removed to allow the normal use of the bathtub or the shower.

U.S. Pub. No. 20060207014 to DeBoer discloses a shower system that provides a corner shower unit which includes a track defined along a vertical height thereof. A lumbar support and a multitude of showerheads are mounted to the track for vertical adjustment. The lumbar support permits a bather standing in the shower to lean against the lumbar support while a multitude of spray jets provide a massage action directly to the bather. A steam generation system is incorporated into the corner shower unit to mist steam from steam ports such that the shower may also be utilized as a steam room. However, the above apparatuses have different setup for providing steam bath and body massage compared to the present invention.

The object of the present invention is to provide an apparatus for converting a normal shower into a multi-purpose facility with steam, sauna and massage features. The apparatus also includes entertainment and communication features such as radio, telephone and input sockets for audio or video devices. Other objects of the present invention will become better understood with reference to the appended Summary, Description, and Claims.

SUMMARY

The invention is to bring a Wet Steam and Dry Sauna Room into an existing shower so people do not have to drive few miles away their homes to take a steam bath or dry sauna and avoid sharing a steam bath in a common steam room and dry Sauna with others, which in many cases may be very dangerous to catch others person disease (such as skin fungus and others diseases). The invention is a panel that by installing into a shower, it will provide the hot wet steam and dry sauna, without needing to build a new drain.

The system consists of 2 parts, the first panel that can be hanged to the wall inside the shower, and the Steam generator and Sauna generator can be hanged to the wall outside of the shower.

The second part can be installed anywhere outside the shower that the 2 parts can be connected. The home owners can cut glass or an acrylic sheet to cover the top of the shower, so the heat of both steam and sauna will not escape. The invention comes to solve a problem of Space. Where in the past only extravagant expensive homes can afford to have extra space to build an expensive steam room. This invention is to aim to give steam bath and sauna to anyone who has a shower and wish to add a steam and sauna function to that existing shower. The system and Sauna system is adaptable to any shower regardless of the size, and style of the shower. The system just fits to any existing shower. The installation is simple; the cost is affordable to everyone. The installation does not require building an extra drain to escape the excess water in the steam generator. The system comes with an entertainment system (audio and video capacity), and water jets massage.

DESCRIPTION

Figure 1:
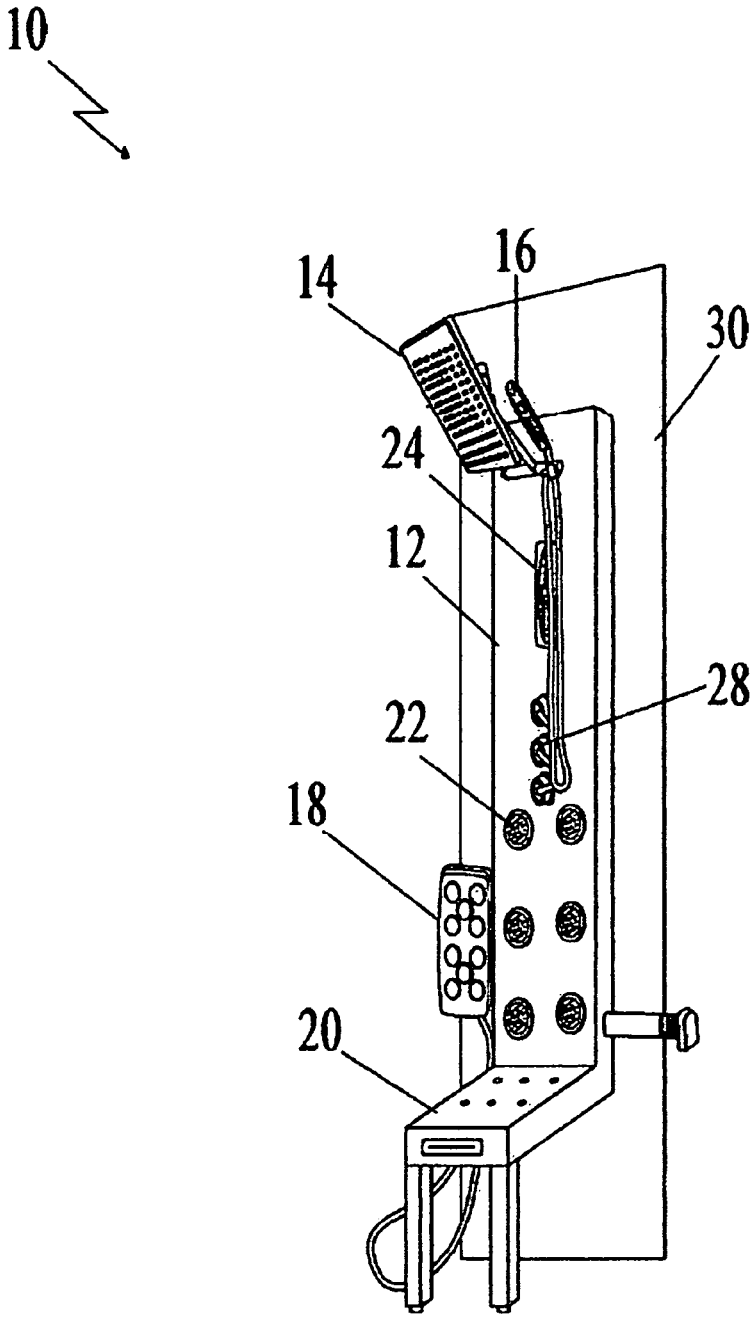
FIG. 1 is perspective view of the apparatus according to the preferred embodiment.
Figure 1B:
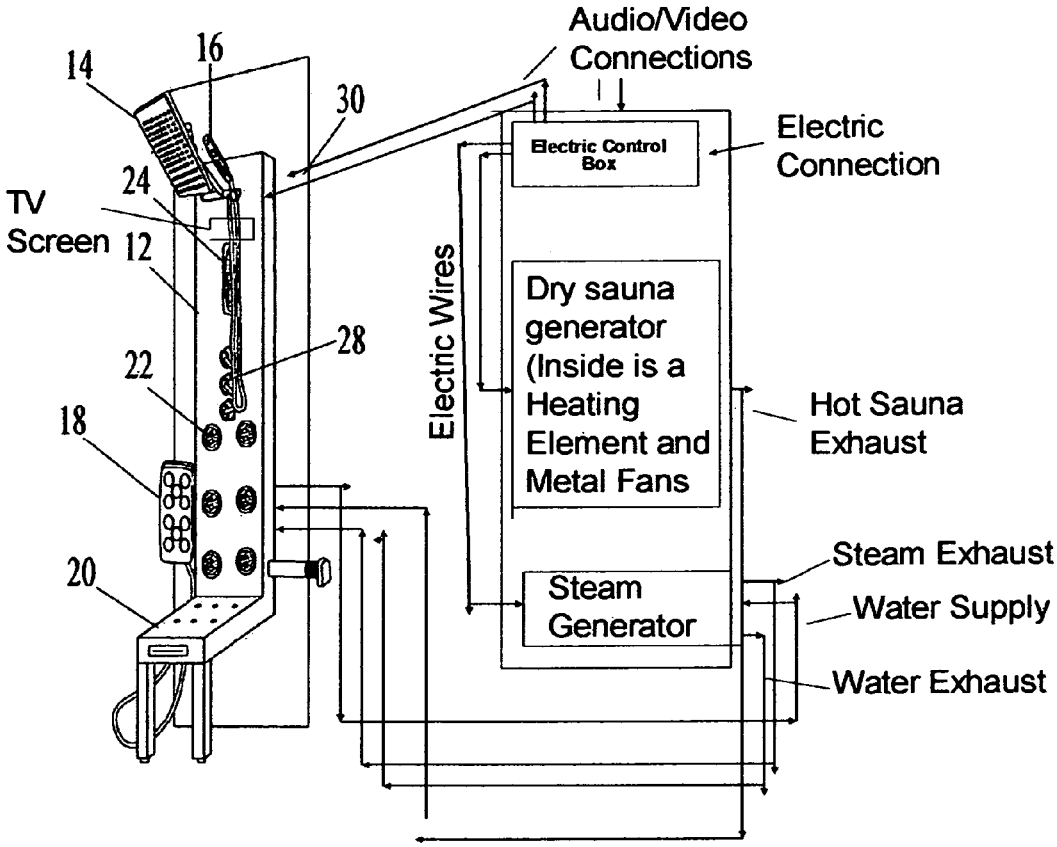
FIG. 1B is a diagram view of the apparatus according to the preferred embodiment.
Figure 1C:
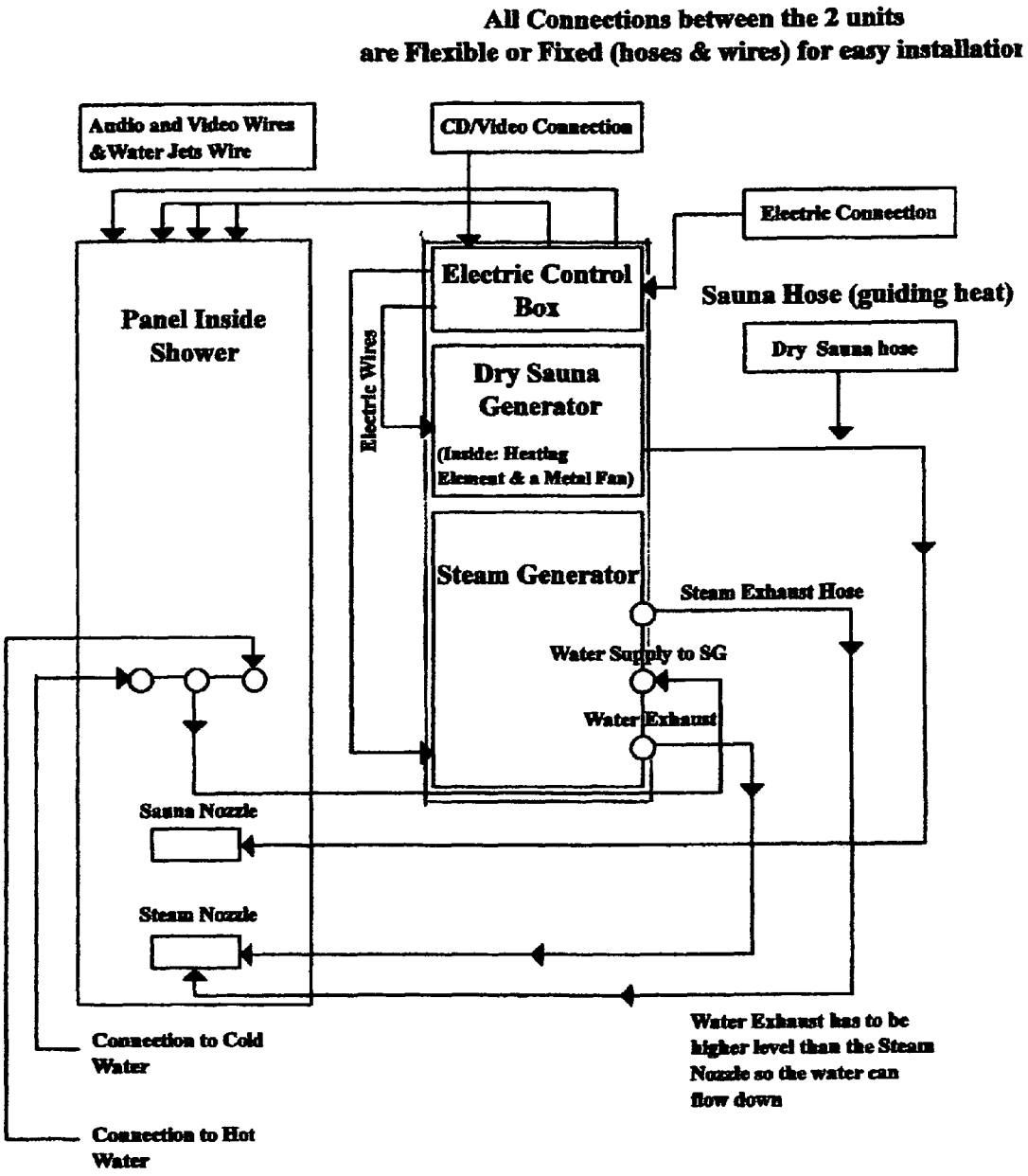
FIG. 1C is a schematic view of the apparatus according to the preferred embodiment.
Figure 2:
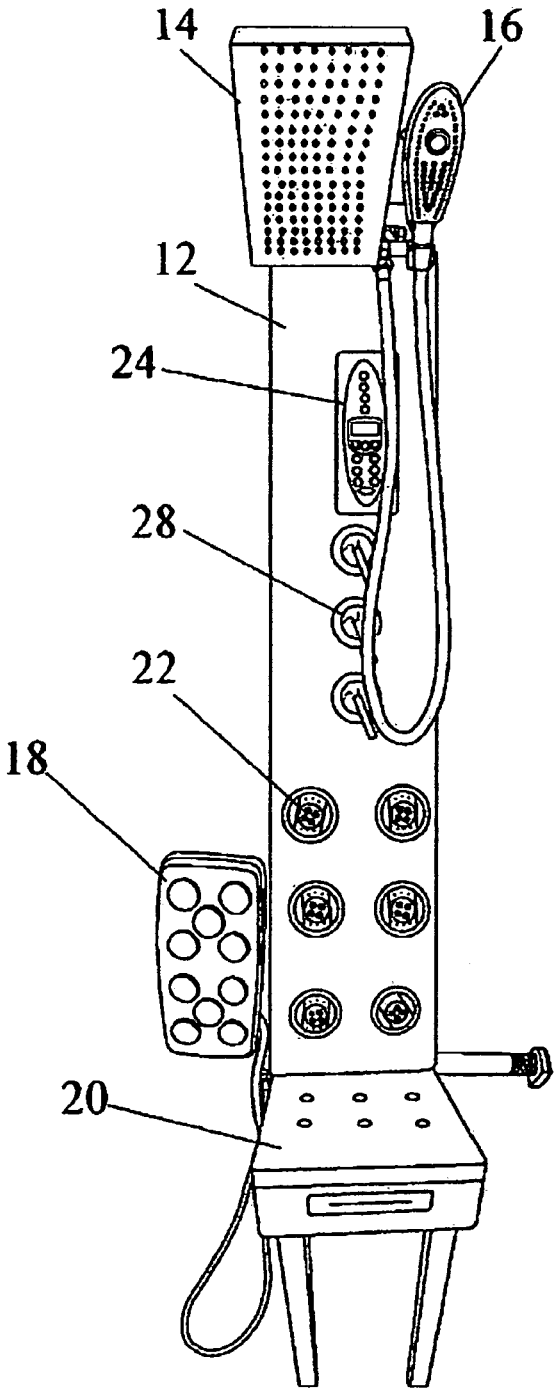
FIG. 2 is a perspective view of the apparatus according to the preferred embodiment.
Figure 2B:
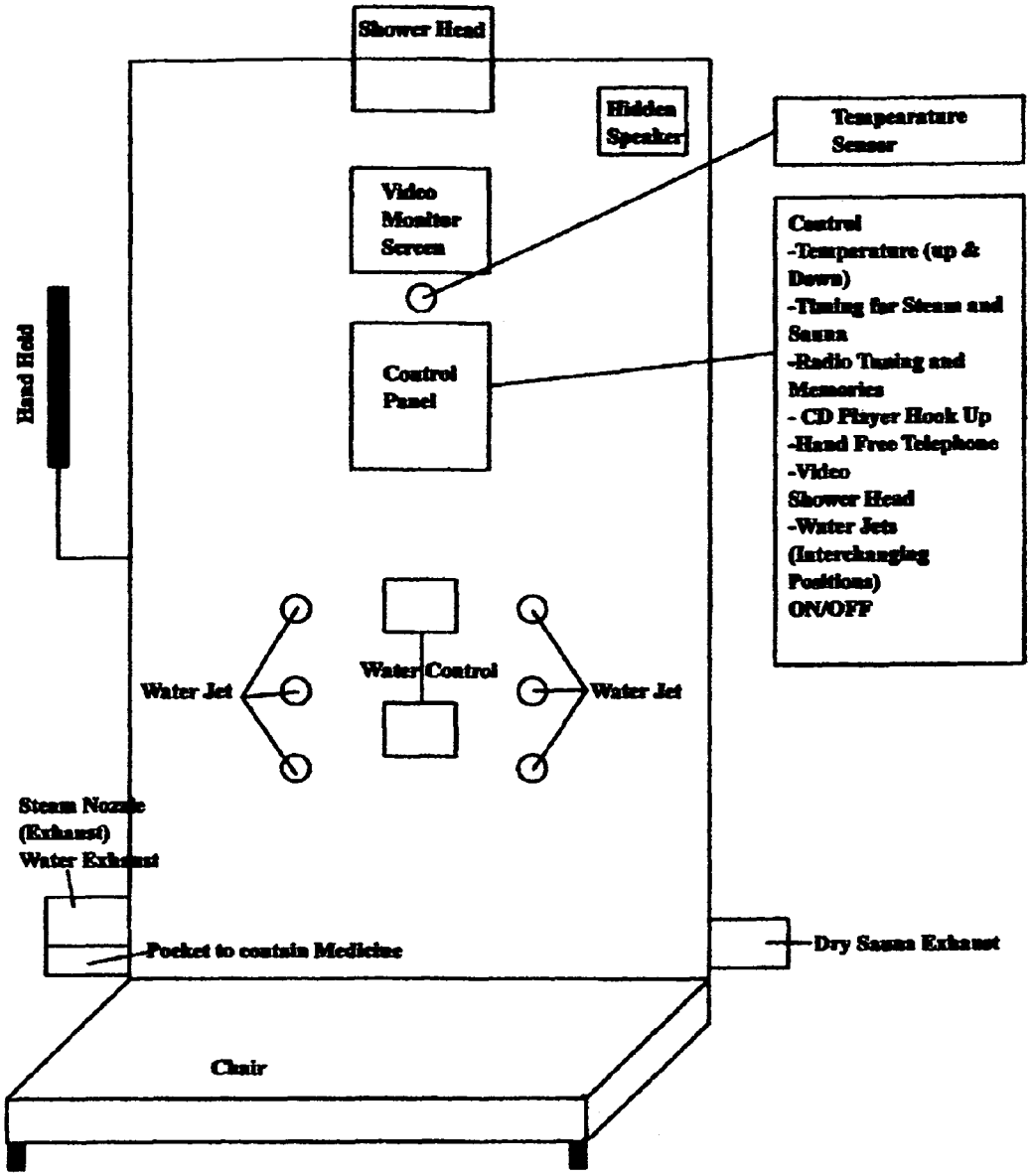
FIG. 2B is a diagram view of panel that is inside the shower.
Figure 3:
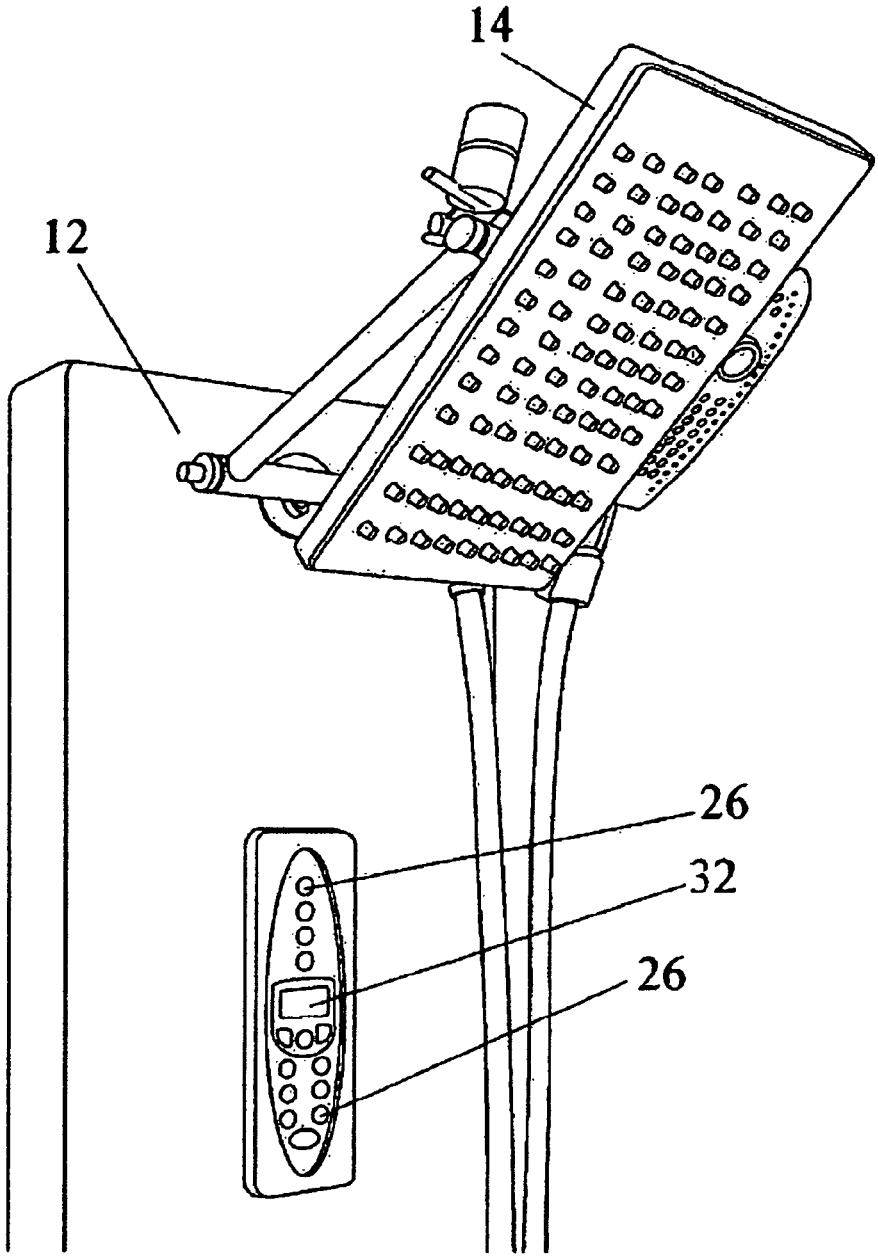
FIG. 3 is perspective view of the top portion of the apparatus.
Figure 4:
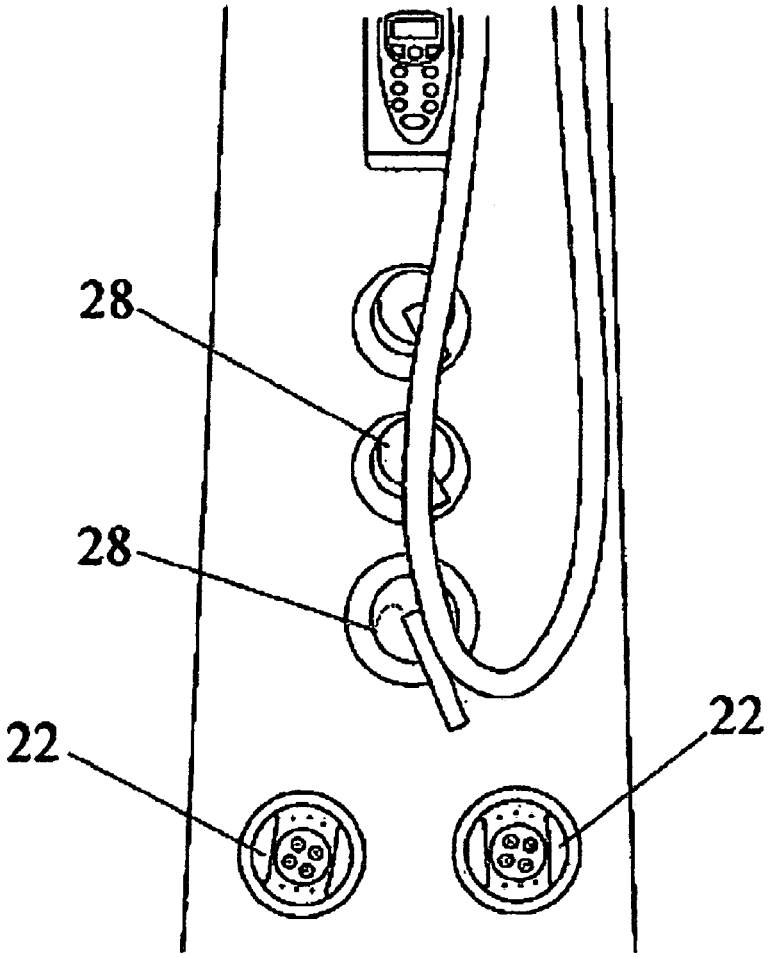
FIGS. 4 and 5 are perspective views of the mid portions of the panel of the apparatus.
Figure 5:
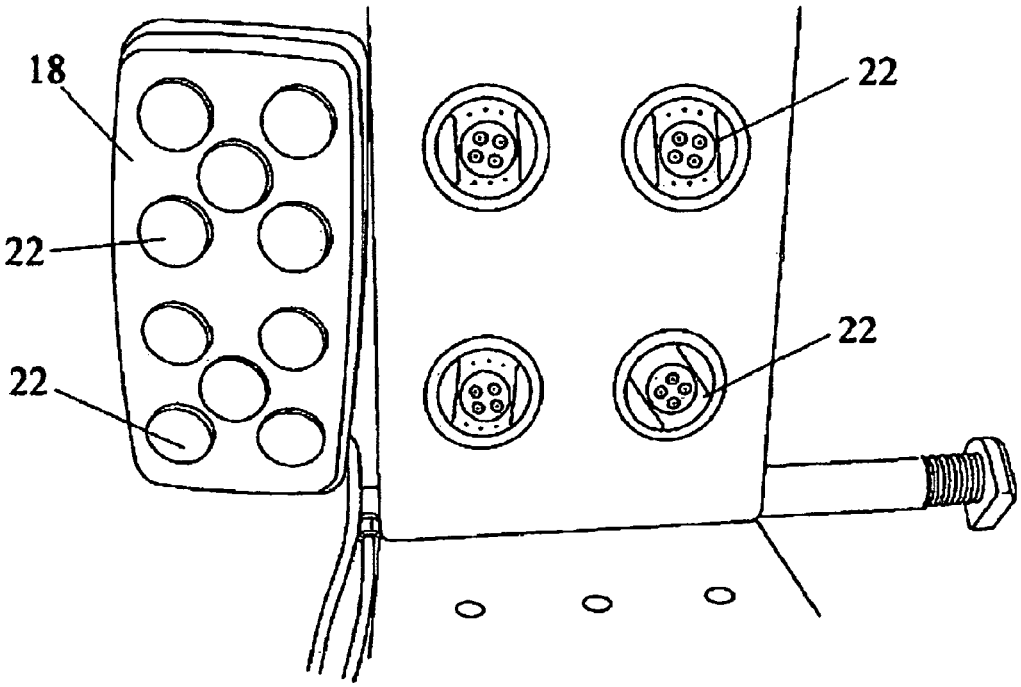
Figure 6:
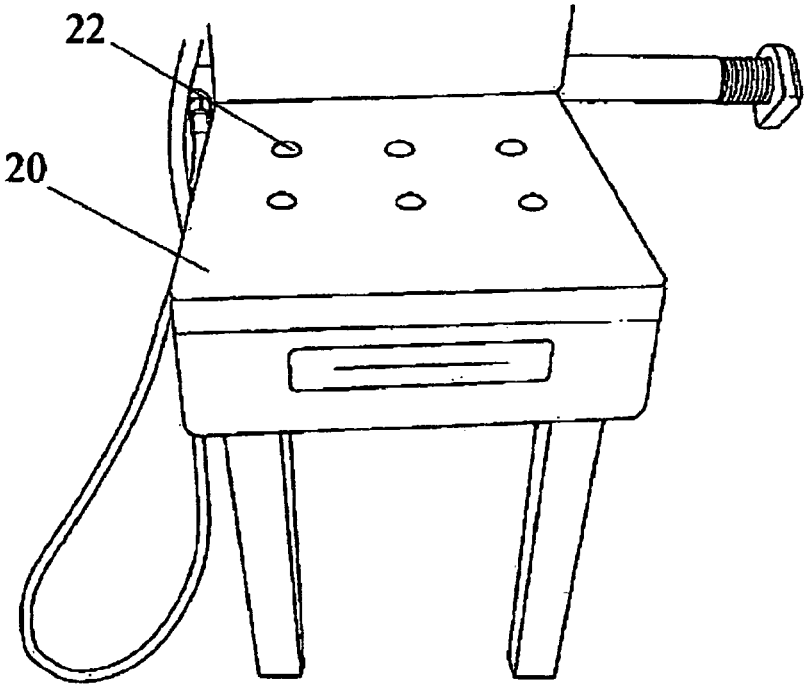
FIG. 6 is a perspective view of the seat portion of the apparatus.
Figure 7:
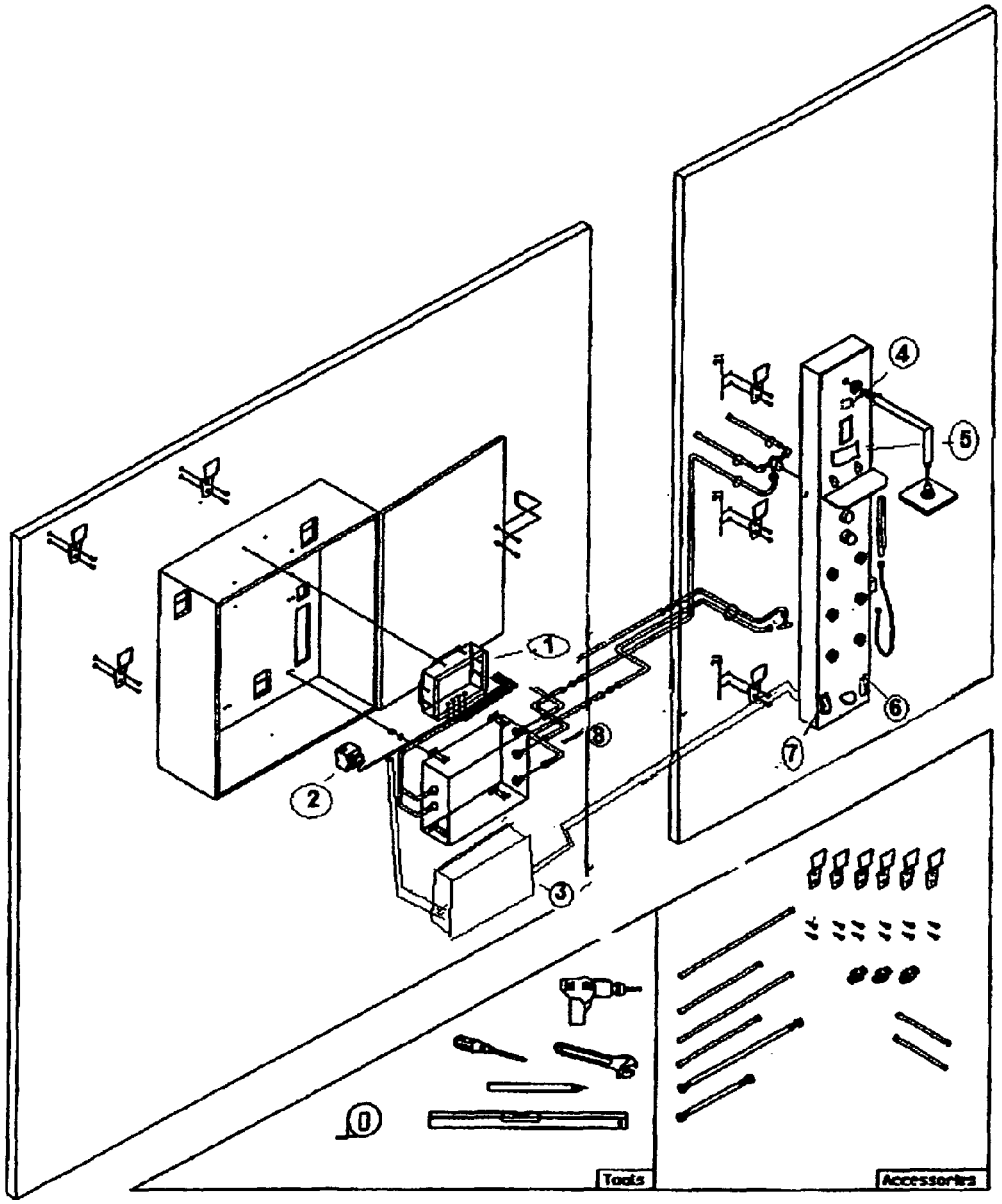
FIG. 7 is a perspective view of the installation of the panels (inside and outside)

The purpose of the invention is to convert a conventional shower found in most homes into a wet and dry sauna room with minimal construction and an affordable price. The device consists of a main control panel which is mounted inside the shower and houses a touch panel which controls the level of heat and moisture the consumer desires along with auxiliary massaging water jets and audio, video and telephone outputs. The panel is waterproof and allows the user to control their spa experience from inside the shower. This panel is attached to an outside box which is usually mounted on the wall next to the shower but can be installed anywhere (even in another room or on an outside wall) that is convenient to the consumer. This box houses the wet steam and dry sauna generators which use electricity to create steam and heat. The box is connected to the panel inside the shower with hoses that run inside the wall and is controlled with the panel via electronic connections. The third component is an acrylic plastic hood the covers the top of the shower to enclose the area and prevent the loss of heat and steam. The hood can be customized to fit any size enclosure the user may have.

The device differs from any other on the market in several significant ways. First, the steam and heat generators are housed outside the shower and away from the hazards posed by electronic generators coming in contact with water. The generators draw a significant amount of electricity to convert liquid water to steam and heat the air for the sauna. Housing them outside the shower removes the very real threat of electrocution that is present in other devices which have the generators inches away from the haphazard spray present inside the shower. No matter how "Waterproof" their enclosure it is dangerous to have such high voltage devices so close to running, spraying water to which the user is in direct contact. Repeated uses over time make the possibility that water will find its way inside the device likely considering the repeated temperature and humidity changes and haphazard spray that any enclosure housed inside the shower would face. The invention removes this possibility entirely.

Second, other devices used to bring the steam and sauna experience into the home require a full-scale renovation of the bathroom or for the device to be installed at the time the home is built at the cost of tens of thousands of dollars. The invention is installed using the existing shower and only requires an afternoon to install and connect at a fraction of the price. The only "construction" required is running the hoses and electronic connections behind the wall in bathroom and connecting the device to the already existing electricity and water supplies. No major renovations are required.

In the same vein, the device uses the existing drain inside the shower for evacuating any excess moisture created by heating the water in the outside box. Other devices require construction of a separate drain at considerable expense. Both the steam and heat generators housed in the outside box are attached to the main shower not only with hoses to provide heat and steam, but also with a peripheral hose to funnel any exhaust moisture into the regular faucet that already exists so it will collect at the bottom of the enclosure and drain in the same manner as the water that is produced by using the shower in a regular manner. No extra drain is needed.

The device also has a video screen and touch pad located on the shower panel which controls audio and video output to relax and entertain the user while the device is operating. There are also optional massaging jets that are housed along the panel which can be set to pulse at alternating intervals and a telephone attachment so the user can communicate with the outside world without interrupting their experience.

The device allows the consumer to safely bring the sauna experience into their existing shower without an exorbitant price. What follows is a detailed description of how it is constructed and how the device operates.

The system for installation based on the preferred embodiment:

For the System: Install the panel on the wall of the shower: Screw in the bracket to hang the panel. Next make a hole on the wall behind the panel to connect the hot and cold water (from the water pipe) to the panel. Locate a place near the shower to hang the Steam Generator and Dry Sauna Box outside of the shower.

For the Steam: From the panel, connect the hose to feed water to the Steam generator that is located outside of the shower. (on the wall, behind the closet, on top of the toilet or anywhere is convenient for the house) The water will be boiled (in the steam generator) with a heating element, and give the hot steam to the steam hose (located on top of the steam generator) and to connect back to the panel where is the steam nozzle.

The excess water in Steam Generator will be pushed out at the end of each use to the water hose (located at the bottom of the Steam Generator to a hose that will be connected back to the panel (at the same place as the Steam exhaust) or anywhere in the panel. In that way, the users will require an expensive drain.

For the Dry Sauna: The air will be heated by an electric heating element and with the Fans (located at the front and back of the Sauna Box will blow the heat to the hose. That hose will guide the hot air into the panel where is located the Sauna exhaust.

To make the steam bath more enjoyable, install a Video and Audio Entertainment system on the panel. The users can listen to the radio, CD player or MP3, or even watch a video. Also install some Rain Shower, and water jets that are controlled by our computer to interchange position.

The present invention can consist of a Hot Wet Steam, Dry Sauna, with Audio Entertainment Systems (Speaker, Radio, CD Player, MP3 player hook up), Video Entertainment System (Video Screen), Communication System (telephone), and Water jets Massage for body. It converts a normal shower into a Steam Room and/or Dry Sauna. It also consists of a Rain Shower and a Hand Held Massage, A Back and Foot Massage. The apparatus is basically a Panel that can be hooked into the wall of the existing shower and connect m the second unit that is located outside of the shower that contains a computer control system, a Steam Generator, and a Heat Generator. To transform an existing shower into a Steam Room and/or Dry Sauna Room, we cut acrylic sheet or glass to cover the top of the shower to avoid the heat of the steam and sauna to escape.

The invention consists of a panel that we can be installed (on the wall) inside of an existing shower and turn that shower into a Wet Steam and Dry Sauna Room.

On that panel:

1) A Big Rain Shower, and Hand Held water massage

2) A Control Panel 3) 6 Water Jets for body Massage

4) An Entertainment system With Audio System (a Speaker, a Radio, a CD Player/or Mp3 Hook up, a Telephone), and a Video system (TV Screen)

5) An Steam nozzle (for Hot steam exhaust)

6) And a Dry Sauna nozzle (for Hot Dry Sauna Exhaust)

7) A Remote Control

The system consists of 2 units:

1) A first unit that goes INSIDE the shower 2) and the Steam Generator, Computer Box and a Dry Sauna Generator that goes inside a box that STAY OUTSIDE of the shower called OUTSIDE box. The 2 units are connected through flexible (or fix) hoses In the invention, the system comes with 2 units:

a) The first unit stay hanged onto the wall (inside the shower) which has no electricity at all.

b) and the second unit STAYS OUTSIDE of the shower (hanging to the wall) that contains a Steam Generator (is like a kettle that boil water and with a hose that guide the hot steam mist into the first unit), and the dry sauna (is like a Hair Blower with heating element and a metal fan to blow the hot air through a hose to guide the hot air into the shower through the first unit), and a computer control system. All connections are connected behind the wall with flexible or hard hoses and Wires.

c) The steam nozzle and the Water drain join together (so the installer don't have to build a new drain (that may be costly) as you can see in the diagram I sent you (page 2 of 6)

The 2 units (first unit inside shower) and Outside box are connected by:

1) For Steam Bath:

a) Steam hose made in metal (stainless steel or copper) covered by an isolant (so the heat do not escape) Hose can be fixed or flexible b) Water Hose made in metal (stainless steel or copper) to supply water from the panel to the steam generator. Hose can be fixed or flexible c) Water exhaust hose made in metal (stainless steel or copper). Hose can be fixed or flexible The water exhaust (3) and Steam exhaust (1) come out at the SAME place connected by a T Shape connection. So the customers DO NOT HAVE TO BUILD A NEW DRAIN for the water exhaust. After the steam bath, the excess water inside the steam generator remaining will drain out (at the same place as steam exhaust)

For the hoses, 2 parts are supplied (for easy installation and adaptable to the length needed for each customers.) The hoses are usually 4 feet and 6 feet (that can be connected together for the full length) the length can be longer or shorter depend on special customer requests. The size of the stainless steel hoses are usually ½ inch. At the end of the steam nozzle, we have a pocket for medicine (where the users can add eucalyptus or other scents.

2) For Dry Sauna:

The hose are metal (usually stainless steel or cooper)(fixed or flexible) can be either ½ inch or 1 inch in diameter depending on the customer's request. They are like other steam hoses, they come in 2 parts in different length and can be connected together (depending on the need of the users). The Hot sauna hose is connected from the Sauna generator to the Sauna Exhaust (that is different from the steam exhaust) on the first unit.

The Steam Generator and Sauna are in the picture separated. But they can also be together in a combined system.

3) Electric Wires to Open the Water Valves for Rain Shower and Water Jets:

To control the water jets:

By pushing the jets button (on the Control Panel) one time, only the electric wire (usually covered by black tape) will let the electric current to open the Top Rain Shower to open the valve for letting the water o go through for Rain Shower water to go through.

By pushing that same button the second time, only the second electric wire (usually covered with color blue tape) will let the electric current to open the valve for top water jet for top massage.

By pushing that same button the third time, only the third electric wire (usually covered with yellow tape) will let the electric current to open the valve in the middle water for middle body massage.

By pushing that same button the fourth time, only the electric wire (usually covered with red tape) will let the electric current to open the valve at the bottom water jet for lower body part massage.

By pushing that same button for the fifth time, the computer will INTERCHANGE the valves opening and closed from top body massage to middle to bottom massage every few second.

By pushing that same button the sixth time, all valves are shut off.

4) Audio, Video and Telephone Wires:

A water proof speaker is located (hidden) on the first unit. All are controlled on the Main Control Panel.

By pushing the button the radio can be activated, pushing that same button the second time to switch the Audio Mode. The flexible audio and Video wires that run from the main Computer box to connect to the Audio and Video Screen.

By pushing on the telephone button, all music will shut and let the Telephone function to work. Whenever there is an incoming call, the music will automatically shut and the Telephone will ring. The users can call out or receive phone calls with music AUTOMATICALLY shut off.

The tiny microphone for the telephone is usually located at the bottom of the Main Control Panel, and the speaker is the same as the hidden speaker.

The Video Screen is a waterproof screen and has a control to volume, channels on the screen. It will be connected to the Main computer control box by a wire.

On the Control Panel. We have the capability to control or set the:

ON/OFF button

Temperature Control Up & Down

Timing of the steam and sauna bath Up & Down

Radio, CD (or MP3) Hook Up

Telephone

Control Volume of the audio (up or down)

20 Radio Station Memories capacities, and Radio Tuning

Water Jets in different jets.

Steam ON/OFF

Sauna ON/OFF

5) Temperature Sensor. A sensor is located on the panel. When the temperature reaches the set level, the computer will stop the Steam generator and/or Sauna. That sensor is connected to the computer by a wire 6) Bacteria Sanitizer: We have the small device located on the first unit for sanitizing the shower from bacteria. Each time the users turn Off the steam or sauna, the Sanitizer will automatically turn ON for 5 minutes to sanitize the shower.

7) The Water Knob: is located on the first unit to guide the water from going to the big rain shower, to hand held or to fill up the tub, and to let the water to stronger or weaker.

8) Control Panel: is touch screen with the different functions (as in the pictures attached) is connected to the computer by a computer wire.

9) The waterproof speaker is connected to the computer by a wire. All wires as above mentioned are detachable and connectable (aider installation).

The Outside box can be located anywhere the users choose. It can be on the wall beside the shower, on the wall in the other room, by the window, in the addict and so on. The Outside box need the steam generator to be higher than the steam exhaust, so after the steam bath, the excess water will flow down by gravity to the water exhaust (same place as the steam nozzle). (If the users decide to place the Outside box at the lower level than the first unit, like in the basement, a bucket or a drain is needed to catch the excess water.

The Outside box is usually a wooden box (or in different material) located outside the shower. It is like a cabinet with a door to open and close. It contains the 3 units: the computer box, the Steam generator and the Dry Sauna. Inside the outside, there is also an electric switch where it receive the supply of electricity and feet the computer box.

Sizes, Materials, Shape, and Colors of units: The sizes of the first unit and the Outside box may vary to fit the need of the customers (for showers with tub or standing showers). Materials, Shapes and Colors may also vary to fit the bathroom decorations, Fashions and budgets of the customers.

My claim is:

1. An apparatus for converting a shower stall into a Steam and/or Dry Sauna Room comprising:

a first unit, wherein the first unit is located in the shower stall and is fluidly connected to a second unit;

the second unit is disposed outside and adjacent to the shower and further comprises a steam generator, a dry sauna and a computer control system;

a remote control for wireless control of the computer control system;

the first unit further comprises:

a steam nozzle connected to the steam generator;

a plurality of water jets that can vary in position;

a heated air exhaust connected to the dry sauna to provide heated air to the shower stall;

a touch panel connected to the computer control system for operating the apparatus;

a video screen to provide visual read outs of system settings and further provide entertainment;

an audio entertainment system further comprising water proof speakers and a music player connection;

a communication system to provide the user with telephonic communication;

a temperature sensor connected to the computer control system to maintain steam and sauna temperature at a predetermined temperature;

a shower sanitizer, wherein the shower sanitizer activates after the shower has been switched off after use to spray and clean the shower stall;

at least one main pipe connection for fluidly connecting the first unit to a main water supply;

at least one second pipe connection for fluidly connecting the first unit to the steam generator; and a plurality of switches to draw water from the main water supply to the shower or allow water to go to the second panel.

* * * * *